US011215389B2

(12) United States Patent
Gosselin

(10) Patent No.: US 11,215,389 B2
(45) Date of Patent: Jan. 4, 2022

(54) REFRIGERATED GEL PACK DIVIDER FOR KEEPING BEVERAGE BOTTLES COOL DURING BEVERAGE BOX TRANSPORT

(71) Applicant: Wine Warden Ltd, Calgary (CA)

(72) Inventor: Benoit Gosselin, Calgary (CA)

(73) Assignee: Wine Warden Ltd, Calgary (CA)

( * ) Notice: Subject to any disclaimer, the term of this patent is extended or adjusted under 35 U.S.C. 154(b) by 180 days.

(21) Appl. No.: 16/582,596

(22) Filed: Sep. 25, 2019

(65) Prior Publication Data

US 2020/0109888 A1 Apr. 9, 2020

(30) Foreign Application Priority Data

Oct. 5, 2018 (CA) ..... 3020033

(51) Int. Cl.
*F25D 3/00* (2006.01)
*F25D 3/08* (2006.01)

(52) U.S. Cl.
CPC ..... *F25D 3/005* (2013.01); *F25D 3/08* (2013.01)

(58) Field of Classification Search
CPC ..... F25D 2303/0841; F25D 2303/0822; F25D 2303/08221; F25D 2303/08222; F25D 3/005; B65D 5/48038
See application file for complete search history.

(56) References Cited

U.S. PATENT DOCUMENTS

| | | | | |
|---|---|---|---|---|
| 4,932,548 | A | 6/1990 | Bensinger | |
| 8,573,002 | B2 | 11/2013 | Ledoux et al. | |
| 2003/0217948 | A1* | 11/2003 | Lantz | B65D 81/3862 206/591 |
| 2004/0262319 | A1 | 12/2004 | Fisher | |
| 2010/0179040 | A1* | 7/2010 | Bale | B65D 5/48038 493/91 |
| 2019/0177071 | A1* | 6/2019 | Coulombe | F25D 3/08 |

FOREIGN PATENT DOCUMENTS

EP 0681963 B1 5/1999

* cited by examiner

*Primary Examiner* — Cassey D Bauer
(74) *Attorney, Agent, or Firm* — ATMAC Patent Services Ltd.; Andrew T. MacMillan

(57) ABSTRACT

A gel pack kit for keeping beverage bottles cool during transport includes a plurality of gel pack parts. The parts include notches allowing the parts to be attached perpendicular to one another and assembled into a gel pack divider. The divider includes a plurality of bottle cooling areas being the spaces between the adjacent gel packs in the assembled divider structure. A method of utilizing the gel pack divider kit to keep beverage bottles cool during transport includes assembling the gel pack kit to form the gel pack divider and then refrigerating the assembled divider. After purchasing bottled beverages such as multiple bottles of wine in a box, an original cardboard divider provided in the box is removed and replaced with the chilled, assembled gel pack divider. The bottles sit in the bottle cooling areas and the gel pack divider provides a cooling effect during transport in the original box.

10 Claims, 6 Drawing Sheets

REFRIGERATED GEL PACK DIVIDER FOR KEEPING BEVERAGE BOTTLES COOL DURING BEVERAGE BOX TRANSPORT

CROSS-REFERENCE TO RELATED APPLICATIONS

This application claims the benefit of priority of Canadian Application No. 3,020,033 filed Oct. 5, 2018, which is incorporated herein by reference.

BACKGROUND OF THE INVENTION

(1) Field of the Invention

The invention pertains generally to portable drink coolers. More specifically, the invention relates to a refrigerated beverage box divider for keeping beverage bottles cool during transport.

(2) Description of the Related Art

When wine touring, newly purchased wine is often left in the truck of a car and can suffer from heating on hot days. Temperatures within a parked vehicle on a hot summer day (35C/95F) can reach temperatures similar what one would experience in a sauna (70C/160F-80C/180F). Such temperatures cook the wine and adversely affect its taste and quality.

To solve this problem, people tend to use picnic coolers, ice packs, cooling blankets, etc. to keep newly purchased wine cool. However, each of these solutions are inconvenient. For one, they tend to take up additional space in the vehicle. Additionally, they usually require the user to unpack and repack the wine in order to take full advantage of the cooling affects of the chosen cooling device.

Wine is usually sold in boxes containing a set number of bottles such as twelve wine bottles (or six bottle for more premium wine), and these boxes do not typically fit within a typical picnic cooler or other cooler. To keep newly purchased wine cool, the user needs to unpack the bottles and store them in the cooler one by one. Because unsecured bottles in a cooler will tend to move around during transport, the user typically needs to separate the bottles with makeshift cushions such as by wrapping the bottles in towels or cushions to avoid impact damage.

BRIEF SUMMARY OF THE INVENTION

According to an exemplary embodiment of the invention there is disclosed a gel pack divider to keep wine bottles cool within the original box in which the wine is purchased.

According to an exemplary embodiment of the invention there is disclosed a plurality gel packs in a kit that when assembled form a gel pack divider that keeps wine bottles cool within the original box in which the wine is purchased.

According to an exemplary embodiment of the invention there is disclosed a method of keeping wine bottles cool within the original box in which the wine is purchased by replacing an original cardboard divider within the box with a refrigerated gel pack divider.

According to an exemplary embodiment of the invention there is disclosed a kit including a plurality of gel pack parts. A first one of the gel pack parts includes a notch allowing at least a second of the gel pack parts to be attached perpendicular to the first gel pack parts. When the plurality of gel pack parts are assembled, the gel pack parts form a gel pack divider that includes a plurality of bottle cooling areas.

According to an exemplary embodiment of the invention there is disclosed the gel pack divider formed by assembling the above-described kit.

According to an exemplary embodiment of the invention there is disclosed a method of keeping beverage bottles cool during transport utilizing the above-described kit. The method includes assembling the kit to form the gel pack divider, refrigerating the gel pack parts in the assembled form, removing an original cardboard divider from a beverage box, and inserting the refrigerated gel pack divider into the beverage box; wherein beverage bottles within the box sit in the bottle cooling areas of the gel pack divider.

An exemplary advantages of some embodiments of the invention includes keeping wine both safe and cool during transport without needing to repack the wine bottles into a new container.

These and other advantages and embodiments of the present invention will no doubt become apparent to those of ordinary skill in the art after reading the following detailed description of preferred embodiments illustrated in the various figures and drawings.

BRIEF DESCRIPTION OF THE DRAWINGS

The invention will be described in greater detail with reference to the accompanying drawings which represent preferred embodiments thereof.

DETAILED DESCRIPTION

Figure 1:
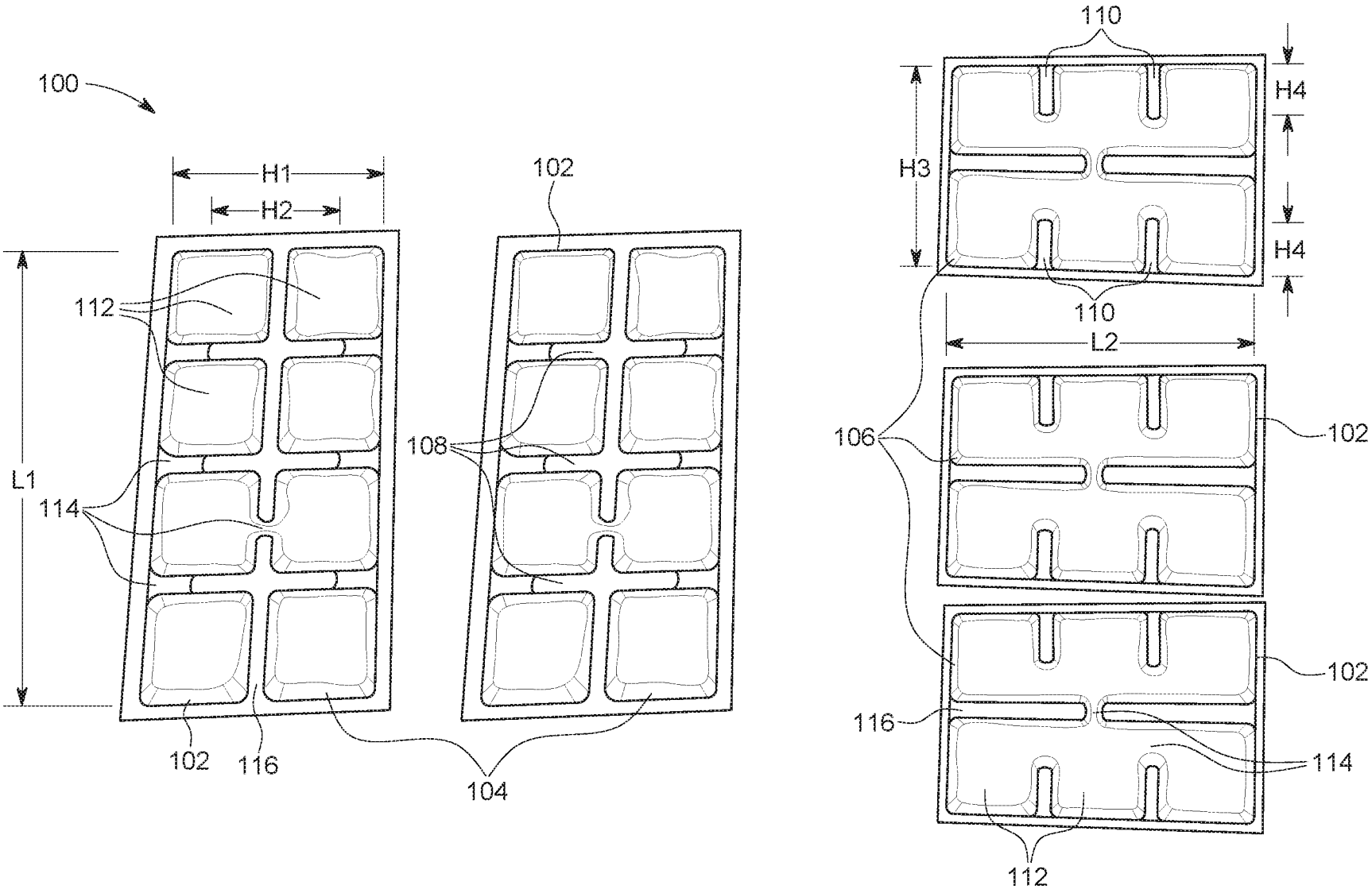
FIG. 1 illustrates a perspective view of a kit formed by a plurality of separate gel packs parts according to an exemplary embodiment of the invention.

FIG. 1 illustrates a perspective view of a kit 100 formed by a plurality of separate gel pack parts 102 according to an exemplary embodiment of the invention. In this embodiment, the kit 100 includes five parts 102 including two cross beam parts 104 and three mid section parts 106.

The cross beam parts 104 are rectangular in shape with a length L1 of approximately one foot (30.5 cm) and a height H1 of six inches (15.5 cm). Each cross beam part 104 includes three center notches 108 where the rectangular structure is split allowing a mid section part 106 to pass through each center notch 108. The center notches 108 have a height H2 of approximately four inches (10.2 cm) long and are distributed evenly along the length L1 of the cross beam part 104.

The mid section parts 106 are also rectangular in shape with a length L2 of approximately nine inches (22.9 cm) and a height H3 of six inches (15.5 cm). Each mid section part 106 includes two pairs of side notches 110 where the rectangular structure of the mid section part 106 is split allowing each mid section part 106 to mate with a cross beam part 104. The side notches 110 have a length H4 of approximately one and a half inches (3.8 cm) and the side notch pairs 110 are distributed evenly along the length L2 of the cross beam part.

The gel pack parts 102 in this embodiment are formed by a plastic bag, polybag, or pouch forming a container into which food-grade gel is filled to form the gel pack part 102. The specific type of plastic and gel can be chosen as desired and different types may be selected and equally successful in different embodiments. In some embodiments, the polybag material is transparent and the color of the gel is black to help prevent children from mistaking the bag for a food product such as a popsicle in the freezer. However, any color and visual design of the gel pack parts may be utilized in other embodiments.

As illustrated in FIG. 1, in the illustrated embodiment, each gel pack part 102 is divided into a number of gel pouch pockets 112 that are interconnected and allow the gel to flow therebetween via gel paths 114. As illustrated, each of the gel pouch pockets 112 in this embodiment are interconnected to each other by at least one gel path 114, which allows the entire gel pack part 102 to be filled with gel in a single fill operation. The thickness of the pouch pockets 112 is greater than the gel paths 114. For instance, the pouch pockets 112 may allow a maximum gel thickness of three-quarters of an inch (1.9 cm) while the gel paths 114 may only allow a maximum gel thickness of one-quarter inch (0.6 cm). Besides the gel paths 114, the pouch pockets 112 are otherwise separated by the polybag material only. In this way, the cross beam parts 104 are generally divided into eight individual pouch pockets 112 separated by seven gel paths 114. Likewise, the mid section parts 106 are generally divided into six individual gel pouch pockets 112 separated by five gel paths 114.

Organizing the pouch pockets 112 in this manner facilitates folding and manipulating the gel pack parts 102 even when the gel is frozen solid. The areas of the gel packs 102 that contain only polybag material such as the almost completely gel-free center line 116 allows the each of the cross beam parts 104 and the mid section parts 106 to fold around an axis formed by the gel-free center line 116. Likewise, the thinner gel paths 114 allow bending even when the gel is frozen solid because it is easier for the user to overcome the rigid nature of the frozen gel by a user simply bending the gel path area 114 back and forth.

Figure 2:
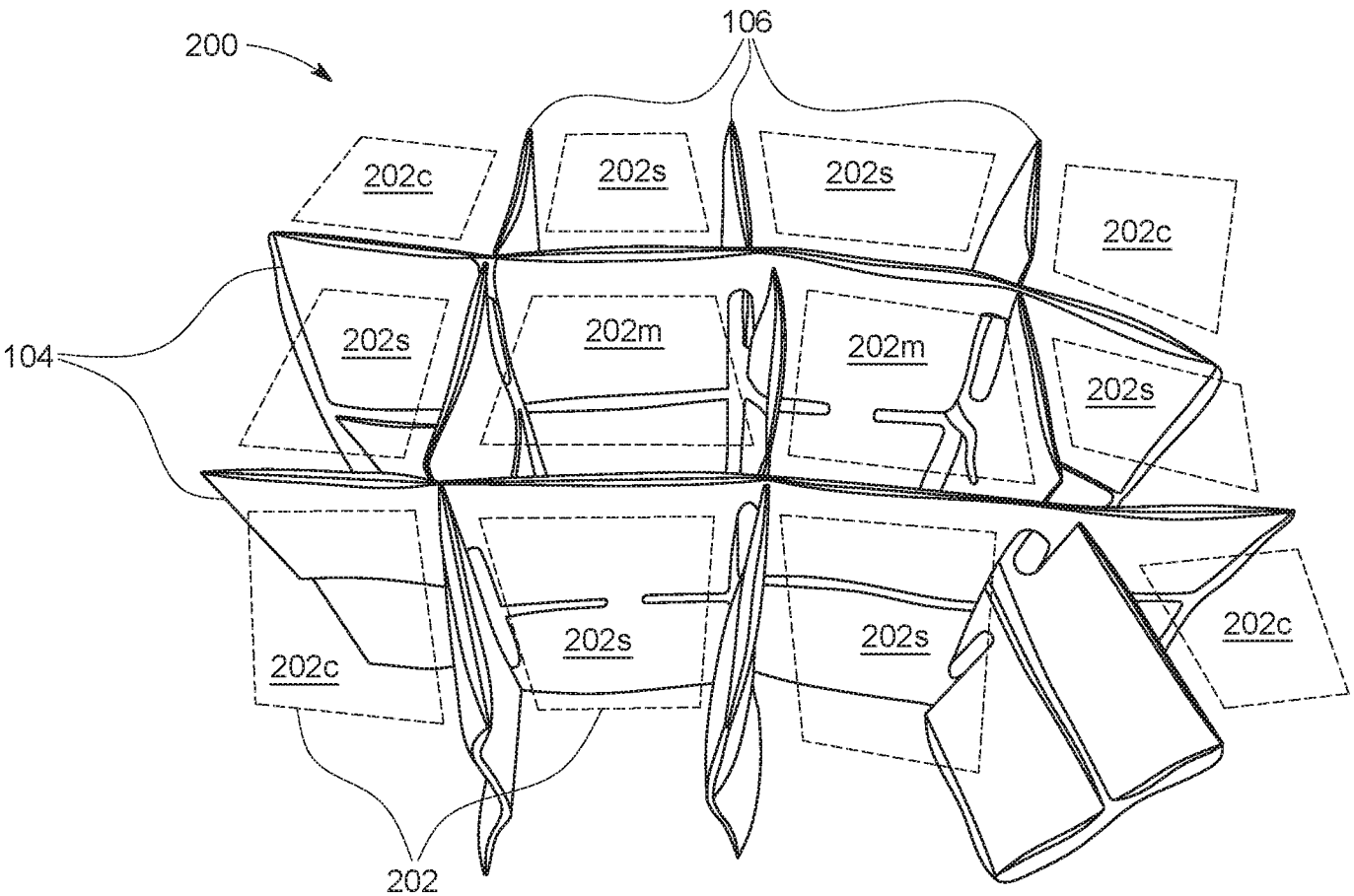
FIG. 2 illustrates a perspective view of the kit of FIG. 2 assembled into a gel pack divider according to an exemplary embodiment.

FIG. 2 illustrates a perspective view of the kit 100 of FIG. 2 assembled into a gel pack divider 200 according to an exemplary embodiment. The gel pack divider 200 includes the two cross beam parts 104 standing vertical on a surface top along their length L1 and parallel one another. Between the cross beam parts 104 are the three mid section parts 106, each standing on the surface parallel one another and perpendicular to the cross beam parts 104. The mid section parts 106 are inserted into a respective center notch 108 of the cross beam parts 104. The side notches 110 on the mid sections 106 interlock around the gel paths 114 between gel pouches 112 on the cross beam parts 104. Likewise, the center notches 108 of the cross beam parts 104 interlock around the gel paths 114 between gel pouches 112 on the mid section parts 106.

Once assembled, the gel pack divider 200 is a stable structure that forms a plurality of twelve square shaped bottle holder areas 202. The middle two bottle holder 202*m* areas are surrounded on four sides, the side bottle holder areas 202*s* are surrounded on three sides, and the corner bottle holder areas 202*c* are surrounded on two sides. As such as least half of the diameter of each bottle receives cooling action from the gel pack.

Figure 3:
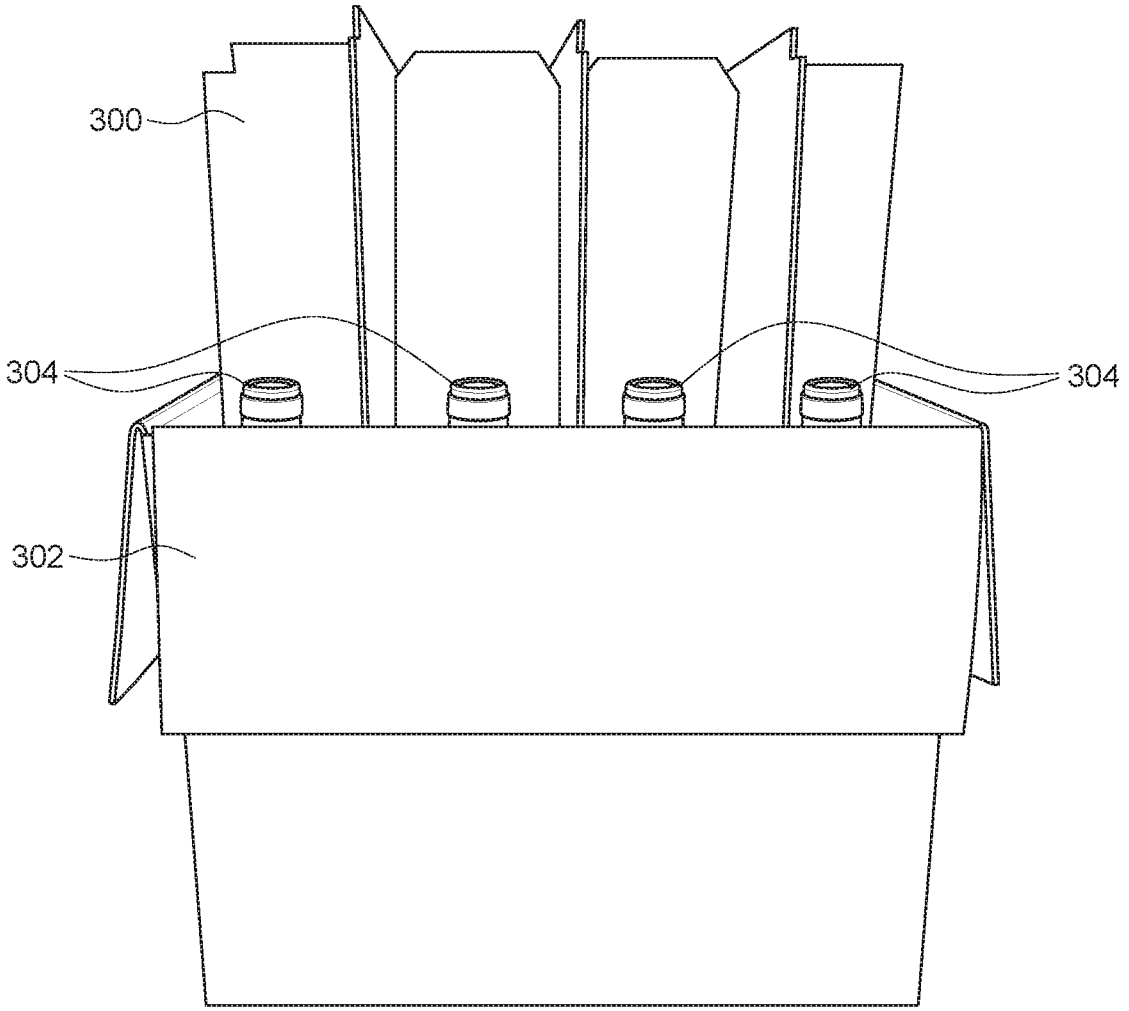
FIG. 3 illustrates a perspective view of removing an original cardboard divider from a twelve-pack wine box during a first step of a method of keeping wine bottles cool during transport according to an exemplary embodiment.

FIG. 3 illustrates a perspective view of removing an original cardboard divider 300 from a twelve-pack wine box 302 during a first step of a method of keeping wine bottles 304 cool during transport according to an exemplary embodiment. Wine is often is often purchased in twelve-pack wine box 302 as illustrated in FIG. 3. The wine box 302 includes a cardboard divider 300 that separates the wine bottles 304 and provides cushioning and vibration protection between the wine bottles 304 during transport. According to an exemplary method of keeping wine bottles 304 cool within the original box 302 in which the wine is purchased, the original cardboard divider 300 within the box 302 is removed by the user and replaced with a refrigerated gel pack divider 200 as illustrated in FIG. 2. Removing the original cardboard divider 300 may simply involve the user pulling up vertically on the cardboard divider 300. The wine bottles 304 may not need to be moved or unpacked from the box 302 during this step, and, assuming the cardboard divider 300 is not attached to the box 302, the cardboard divider 300 can simply be lifted out of the box 302.

In other situations, the original cardboard divider 300 may be glued or otherwise attached to inside surfaces of the box 302. In this case, the user may need to separate the attached edges of the divider 300 from the box 302 such as using a knife or a prying tools such as a putty knife or other flat surfaced tool. Once the original cardboard divider 300 is no longer physically attached to the box 302, the separated cardboard divider 300 is lifted out of the box. In many cases, the wine bottles 304 do not need to be unpacked during removal of the original cardboard divider 300 even when the original cardboard divider 300 is glued or otherwise attached to the inside surface of the box 302.

Figure 4:
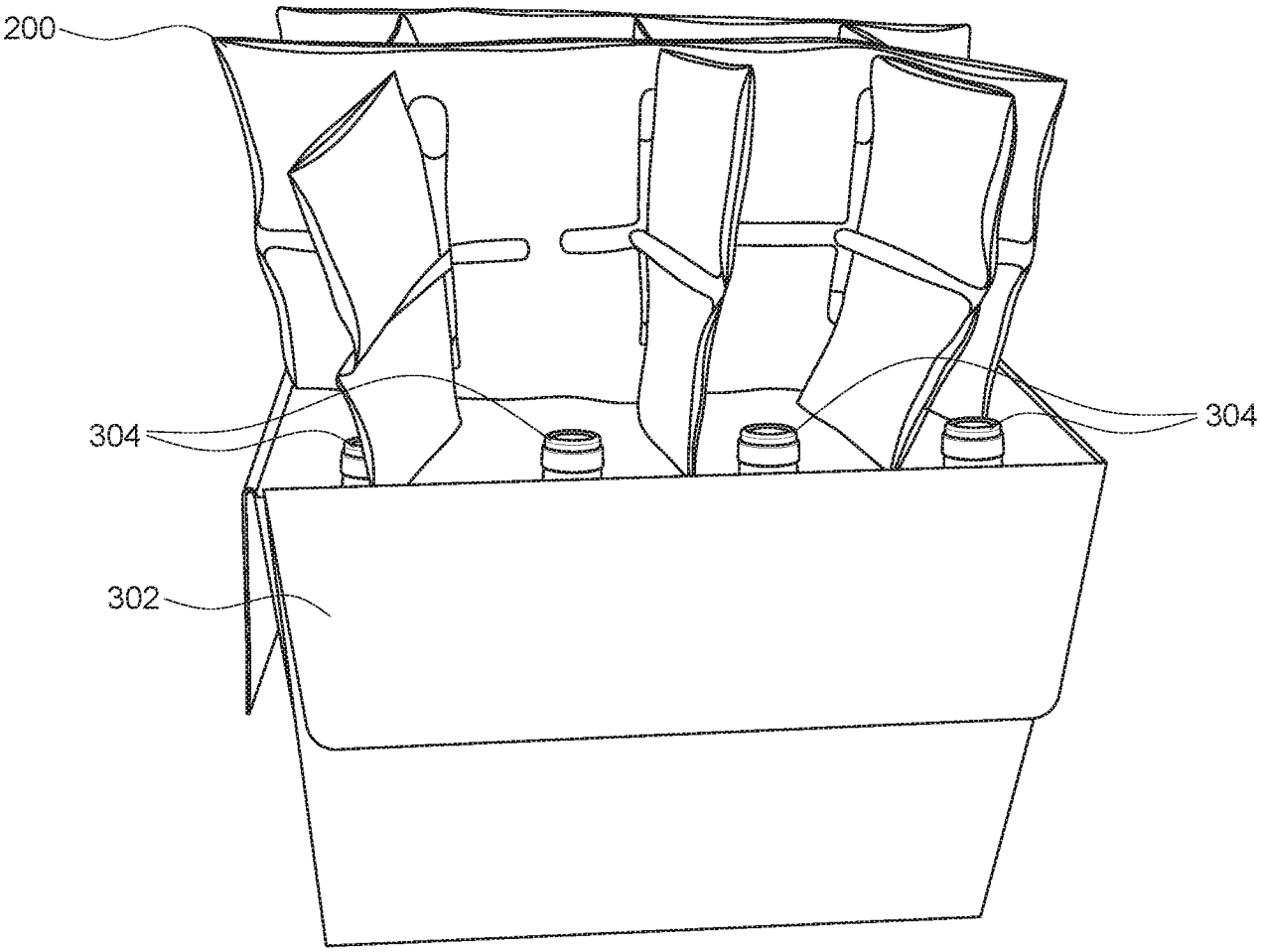
FIG. 4 illustrates a perspective view of inserting the gel pack divider of FIG. 2 between the wine bottles in the twelve-pack wine box of FIG. 3 during a second step of a method of keeping wine bottles cool during transport according to an exemplary embodiment.

FIG. 4 illustrates a perspective view of inserting the gel pack divider 200 of FIG. 2 between the wine bottles 304 in the twelve-pack wine box 302 of FIG. 3 during a second step of a method of keeping wine bottles 304 cool during transport according to an exemplary embodiment. After removing the original cardboard divider 300 from the wine box (see FIG. 3), a pre-refrigerated gel pack divider 200 is easily inserted between the wine bottles 304 and effectively takes the place of the original cardboard divider 300. The gel pack divider 200 thereby provides cooling action to the wine bottles 304 even as the wine bottles 304 stay undisturbed within their original box 302.

Figure 5:
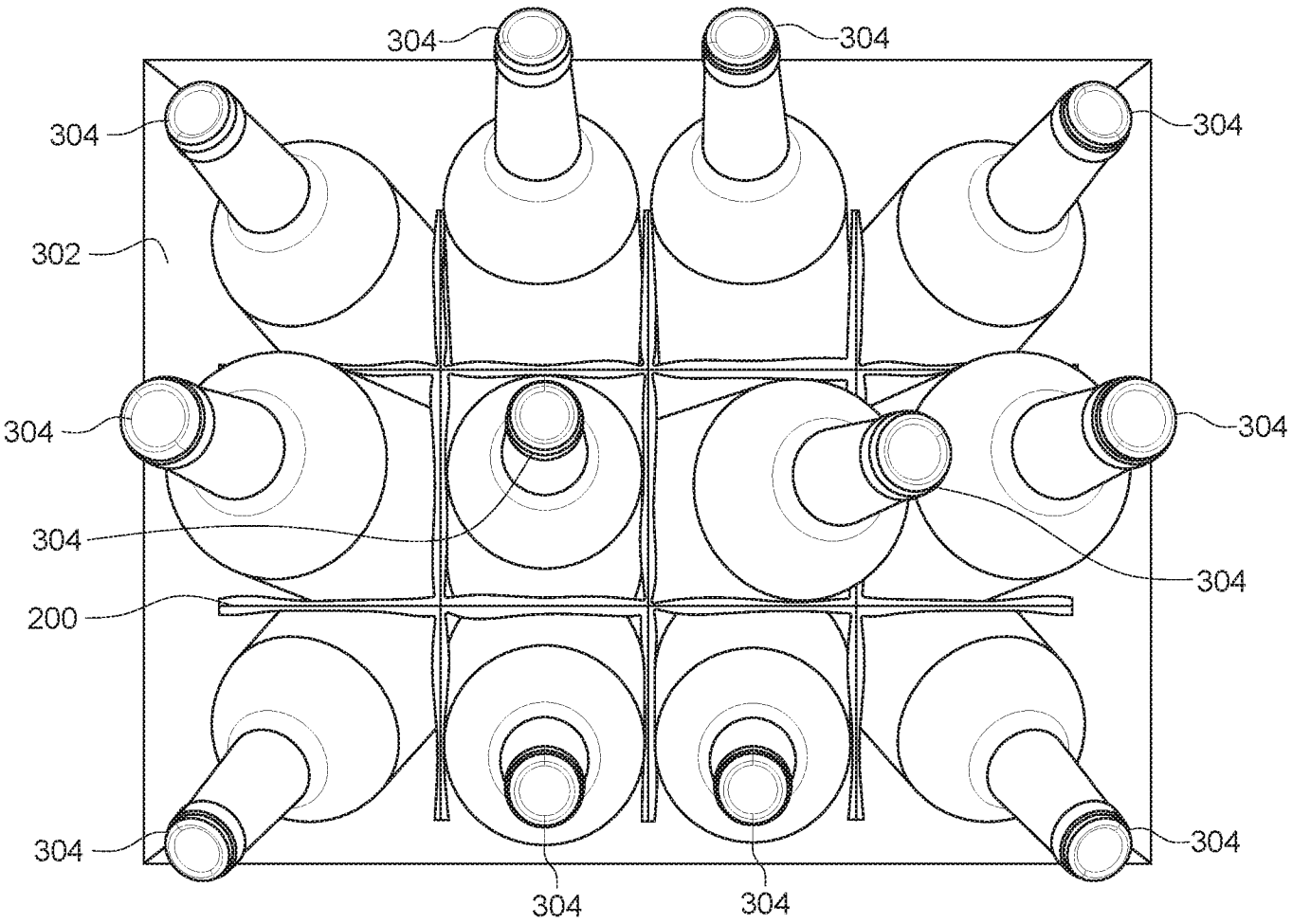
FIG. 5 illustrates a top-down view of the twelve-pack wine box of FIG. 4 while the wine bottles are separated by the gel pack divider of FIG. 2 according to an exemplary embodiment.

FIG. 5 illustrates a top-down view of the twelve-pack wine box 302 of FIG. 4 with the wine bottles 304 being separated by the gel pack divider 200 of FIG. 2 according to an exemplary embodiment. As illustrated, each wine bottle 304 is adjacent to at least two edges of the gel pack parts 102 and is thereby kept at a cool temperature as long the gel pack 200 remains cool. Typically, the gel pack 200 retains its coolness for up to seven hours, which is plenty of time for typical wine touring event where wine boxes 302 may be stored in a user's vehicle as the user travels to and from wineries.

Exemplary benefits of gel pack dividers 200 disclosed herein include not requiring the user to unpack and repack wine bottles 304 into other containers such as cooler boxes, reduced storage requirements in the user's vehicle from being able to keep the wine bottles 304 in their original box 302, and reduced potential for accidental drops and damage to wine bottles 304 because the bottles 304 may remain stationary in their original box 302 while the original cardboard divider 300 is replaced with the gel pack divider 200. Likewise, the wine bottles 304 are kept safe from vibrations during transport because the gel pack divider 200 acts to cushion the wine bottles 304 from one another during transport.

In some embodiments, the gel is selected to still have a degree of softness even when frozen to temperatures down to 0° F. (−18° C.). Having the gel pack parts 102 retaining some fluid-like properties at these temperatures helps allow the gel pack divider 200 to provide a cushion effect between the wine bottles 304 during transport such as to help protect against vibrations. In other embodiments, the gel pack parts 102 may have an outer cloth layer to provide a cushion effect during periods of time when the gel is frozen completely solid. Other types of outer layers and covers may be applied to the outside surface of the gel pack parts such as cloth, neoprene, foam, fabric, etc. In some embodiments, the gel pack parts 102 are themselves placed within neoprene or other material-type pouch for providing cushioning. In some embodiments, the outside layer of the gel pack parts 102 is water absorbent to absorb any condensation that may form on the cooled wine bottles 304 during transport in a humid environment. Absorbing condensation into the gel pack 102 outer layer may be beneficial to avoid water damage to the labels on the wine bottles 304.

Figure 6:
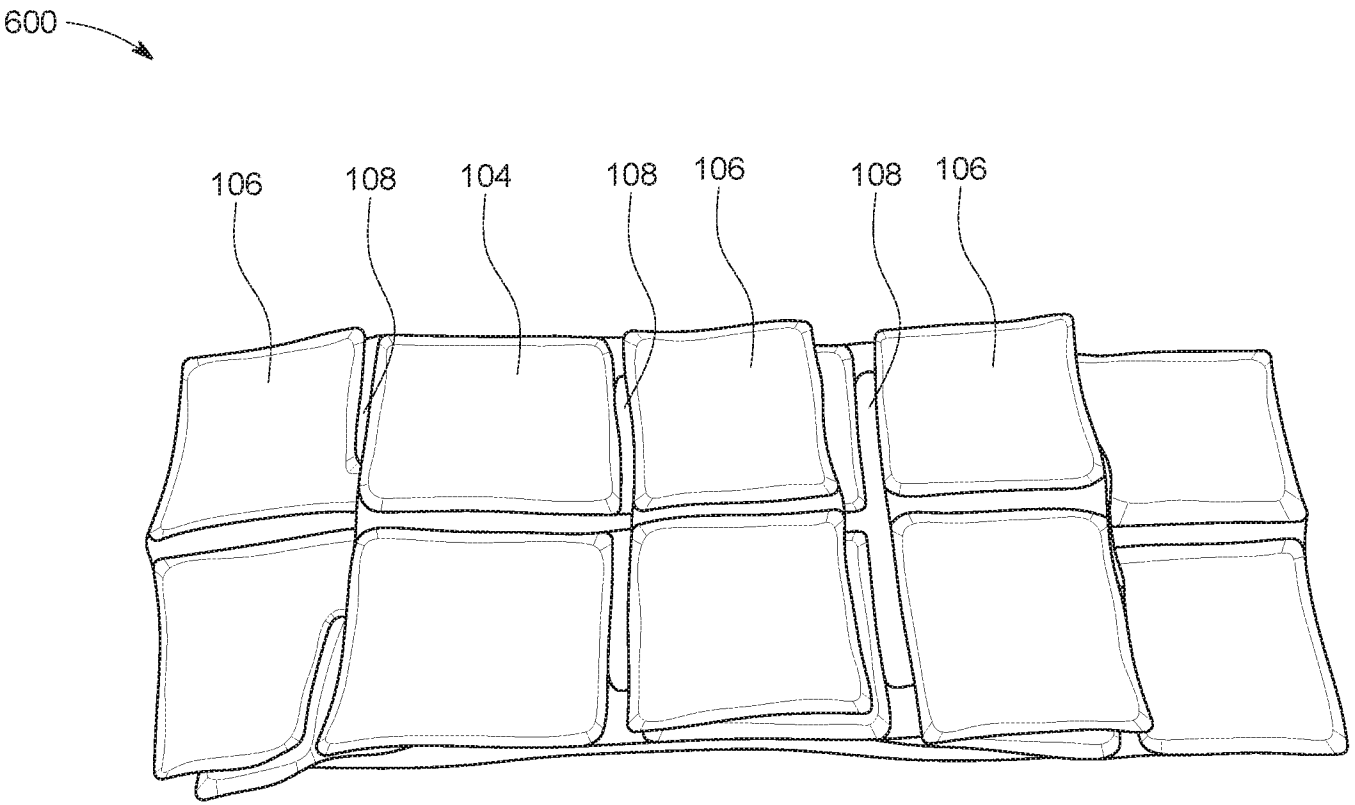
FIG. 6 illustrates a perspective view of the kit of FIG. 2 assembled into the gel pack divider but folded into a folded configuration for storage in a freezer.

FIG. 6 illustrates a perspective view of the kit of FIG. 2 assembled into the gel pack divider and folded for storage in a freezer. In some embodiments, the gel pack parts 102 cannot be assembled together into the gel pack divider 200 after the gel pack parts 102 are frozen solid. For this reason, in these embodiments, the gel pack divider 200 is assembled and folded into a folded configuration 600 illustrated in FIG. 6 prior to freezing the gel pack parts 102. The unfrozen parts 102 are soft and pliable thereby allowing the various gel pouch pockets 112 to be passed through the notches 108, 110 during assembly by the user. The assembled divider 200 can also be taken out of the box 302 after usage and stored overnight in the folded configuration 600 of FIG. 6 in a freezer/hotel minibar. In this way, the folded divider 600 is refrigerated overnight and can be reused the next day or the next time the users does some wine touring/traveling. Beneficially, the divider 200 can be used multiple times.

In an exemplary embodiment, a gel pack kit 100 for keeping beverage bottles 304 cool during transport includes a plurality of gel pack parts 102. The parts 102 include notches 108, 110 allowing the parts 102 to be attached perpendicular to one another and assembled into a gel pack divider 200. The divider 200 includes a plurality of bottle cooling areas 202 being the spaces between the adjacent gel pouch pockets 112 in the assembled divider structure 200. A method of utilizing the gel pack divider kit 100 to keep beverage bottles 304 cool during transport includes assembling the gel pack parts 102 of the kit 100 to form the gel pack divider 200 and then refrigerating the assembled gel pack divider 200. After purchasing bottled beverages such as multiple bottles 304 of wine in a box 302, an original cardboard divider 300 provided in the box 302 is removed and replaced with the assembled and frozen gel pack divider 200. The bottles 304 sit in the bottle cooling areas 202 and the gel pack divider 200 provides a cooling effect during transport in the original box 302.

Although the invention has been described in connection with preferred embodiments, it should be understood that various modifications, additions and alterations may be made to the invention by one skilled in the art. For example, although the above-description has focused on cooling wine bottles 304, gel pack dividers 200 as disclosed herein may likewise be utilized to cool other types of containers sold in a box such as beer bottles, pop bottles, and in general any type of beverage. Likewise, both food and non-food products may also be cooled during transport using a gel pack divider 200 in a similar manner.

The above described method of keeping wine bottles cool 304 within the original box 302 in which the wine is purchased by replacing an original cardboard divider 300 within the box with a refrigerated gel pack divider 200 is one exemplary embodiment. However, the described steps are not restricted to the exact order stated, and, in other configurations, some steps may be omitted or other intermediate steps added. For example, rather than a user performing the method after purchasing wine and loading the wine box 302 into their vehicle, the method may instead be performed by an employee of a winery upon customer purchase of wine. The winery may sell pre-refrigerated gel pack dividers 200 to wine tour visitors as an added product to help keep their newly purchased wine cool as they finish their tour and drive home.

The shapes and sizes of the gel pack parts 102 may also be modified in other embodiments. For instance, a smaller version may include one cross beam part 104 and two mid section parts 104 that together form a gel pack divider with six bottle cooling areas 202. This smaller version may be utilized with premium wine boxes 302 that typically include only six bottles 304. Likewise, any number of cross beam parts 104 and mid section parts 106 to form a gel pack divider 200 with any desired number of bottle cooling areas 202 may be employed in other embodiments. Each gel pack part may include any number of center and side notches 108, 110 to allow assembling the various parts 102 into an assembled divider structure 200.

The lengths, heights, and thicknesses of the gel pack parts 102 may also be adjusted in other embodiments to match and be compatible with any target beverage container or box 302. For instance, the length L1 of the cross beam parts 104 may substantially match the inside length of the target wine box 302 and the length L2 of the mid section parts 106 may substantially match the inside width of the target wine box 302. The heights H1 may be configured as desired and in some embodiments rise to about one half the height of the bottle 304 that is being stored in the box 302. One half of bottle height has benefits in some embodiments of reducing the weight of the gel pack divider 200 in comparison with a full-height embodiment while still providing ample cooling effect and cushioning protection between bottles 304. However, full-bottle-height gel pack dividers 200 are also acceptable and will provide longer cooling effect for extended trips in other embodiments.

Although the above embodiments have gel pack parts 102 that include two different types of parts 102, namely, cross beam parts 104 and mid section parts 106; in other embodiments, different numbers of types of gel pack parts 102 may be used to form the kit and associated gel pack divider 200. For instance, a gel pack divider 200 may be formed using two identical gel pack parts 102 that each include at least one side notch 110. Such a gel pack divider 200 would include four bottle holder areas 202. Likewise, any number of different types of gel pack parts 102 that fit together in any desired way to form an assembled gel pack divider 200 may be used in other embodiments.

Functions of single modules may be separated into multiple units, or the functions of multiple modules may be combined into a single unit. For instance, rather than a kit 100, the gel pack divider 200 may have the various pack parts 102 pre-assembled into the correct shape. In other embodiments, the entire gel pack divider may be manufactured as single integrated structure rather than individual parts 102 that are assembled. Likewise, although the above disclosure has focused on gel packs, any type of refrigerable material that will hold its coldness over time may form the gel pack parts 102 and/or the gel pack divider 200 in other embodiments. All combinations and permutations of the above described features and embodiments may be utilized in conjunction with the invention.

What is claimed is:

1. A method of keeping one or more beverage bottles cool during transport utilizing a kit having a plurality of gel pack parts; wherein a first one of the gel pack parts includes a notch allowing at least a second one of the gel pack parts to be attached perpendicular to the first one of the gel pack parts; and, when the plurality of gel pack parts are assembled, the gel pack parts form a gel pack divider that includes a plurality of bottle cooling areas, the method comprising:

assembling the kit to form the gel pack divider in an assembled configuration;

refrigerating the gel pack divider in the assembled configuration;

removing an original cardboard divider from a beverage box; and inserting the gel pack divider into the beverage box;

wherein the beverage bottles within the beverage box sit in the bottle cooling areas of the gel pack divider.

2. The method of claim 1, wherein the beverage box is a wine box.

3. The method of claim 1, further comprising not removing beverage bottles in the beverage box while replacing the original cardboard divider with the gel pack divider.

4. The method of claim 1, wherein each of the bottle cooling areas substantially covers at least one half of a diameter of a bottle placed thereinto.

5. The method of claim 1, wherein the plurality of gel pack parts comprises:

one or more first gel pack part types; and one or more second gel pack part types.

6. The method of claim 5, wherein the one or more first gel pack part types are cross beam parts each including at least one center notch in a middle area, the at least one center notch allowing passage therethrough of a particular one of the second gel pack part types.

7. The method of claim 5, wherein the one or more second gel pack part types are mid section parts each including at least one pair of side notches, the at least one pair of side notches allowing passage therethrough of a particular one of the first gel pack part types.

8. The method of claim 5, further comprising orientating the first gel pack part types perpendicular to the second gel pack part types when assembling the kit to form the gel pack divider in the assembled configuration.

9. The method of claim 5, wherein at least one of the first gel pack part types and the second gel pack part types includes a plurality of gel pouch areas containing gel and interconnected by at least one gel path.

10. The method of claim 5, wherein at least one of the first gel pack part types and the second gel pack part types includes a gel-free center line.

* * * * *